US005108205A

United States Patent [19]

Stone

[11] Patent Number: 5,108,205

[45] Date of Patent: Apr. 28, 1992

[54] DUAL LEVER PAPER GAP ADJUSTMENT MECHANISM

[75] Inventor: Lawrence A. Stone, Endicott, N.Y.

[73] Assignee: International Business Machines Corp., Armonk, N.Y.

[21] Appl. No.: 664,255

[22] Filed: Mar. 4, 1991

[51] Int. Cl.[5] ..... B41J 11/20

[52] U.S. Cl. ..... 400/56; 400/656; 400/703

[58] Field of Search ..... 400/56, 57, 58, 59, 400/649, 656, 703

[56] References Cited

U.S. PATENT DOCUMENTS

| | | | |
|---|---|---|---|
| 3,155,032 | 11/1964 | Antonucci | 101/45 |
| 4,248,146 | 2/1981 | Miyasaka et al. | 101/93.03 |
| 4,773,772 | 9/1988 | Hanna et al. | 400/58 |
| 4,932,797 | 6/1990 | Emenaker et al. | 400/56 |
| 4,990,004 | 2/1991 | Kawahara et al. | 400/56 |

FOREIGN PATENT DOCUMENTS

| | | | |
|---|---|---|---|
| 2500418 | 9/1975 | Fed. Rep. of Germany | 400/58 |
| 3008540 | 9/1981 | Fed. Rep. of Germany | 400/56 |
| 0060280 | 5/1981 | Japan | 400/656 |
| 0167481 | 12/1981 | Japan | 400/56 |
| 0195678 | 12/1982 | Japan | 400/56 |
| 0222373 | 12/1984 | Japan | 400/649 |

OTHER PUBLICATIONS

"Printer Mechanisms", IBM Tech. Disclosure Bulletin, vol. 22, No. 8B, Jan. 1980, pp. 3525-3526.

*Primary Examiner*—Eugene H. Eickholt
*Attorney, Agent, or Firm*—John S. Gasper

[57] ABSTRACT

A paper gap adjustment mechanism having two coaxially mounted cams which have a camming surface with a linear transition area for forms thickness adjustment and an adjacent ramp area for moving the platen open position plus a straight radius area at the top of the ramp area. A lever is attached to the cams for both controlling forms thickness and platen gap open but the printer operator actuates this lever itself only when controlling the forms thickness positions. A second lever is rotatable on the cam shaft also. The second lever is provided with detent means engageable by the first lever so that rotation of the second lever rotates the first lever and the cams from the set position of the first lever to the open position. The detent means has multiple set positions at which the first lever is engaged when the first lever is rotated to set thicknesses. Rotation of the second lever from the open position to closed position automatically returns the first lever to the prior set position. The invention also provides means operated by the first lever for indicating the paper thickness setting of the first lever. Means is also provided for detecting when the first lever has rotated to its open position.

12 Claims, 9 Drawing Sheets

DUAL LEVER PAPER GAP ADJUSTMENT MECHANISM

FIELD OF THE INVENTION

The invention is related to printing machines and more particularly to printers having a mechanism for controlling the paper gap in printers. While not necessarily limited thereto, the invention has particular utility in impact line printers having a paper gap between a moving type carrier and a row of print hammers and which is designed to be operated manually.

BACKGROUND OF THE INVENTION

It is common in printers to have means to change the size of the paper gap between cooperating elements of the print mechanism, such cooperating print elements being either print hammers and a type carrier, such as an engraved band or drum, of high speed impact line printers or the print head, wheel or other impression forming elements and the platen of serial type printers. The purposes of changing the gap size is setting the gap to accommodate different forms thickness and for backing the platen away such that there is clearance for loading forms, ribbons and print bands. Typically, there are two separate mechanisms to accomplish these tasks. The platen gap open mechanism holds the band drive unit against a stop when in the printing mode while the forms thickness mechanism controls the gap distance, which is set by an operator. When the platen gap open mechanism is actuated, the band drive unit is disengaged from it's stop and the entire band drive unit moves away from the printer hammers. The use of two such mechanisms can be expensive. An early example of this is shown in U.S. Pat. No. 3,155,032. Later examples of such gap changing mechanisms are found in U.S. Pat. Nos. 4,248,146; 4,773,772 and 4,932,797.

A gap adjusting mechanism having a single camming means and a single operator means therefor which is capable of achieving both forms thickness adjustment and gap opening for installation of forms is described in copending application Ser. No. 07/66,265, filed on 03/01/91 now U.S. Pat. No. 5,104,244. In that application, the camming means comprises cam elements which have a cam surface profile which produces either thickness adjustment or opening of the gap. In that mechanism, the thickness setting is lost when the operator is used to open the gap for installation of the forms. This invention is designed to enable gap opening with a return to the original thickness setting of the cams.

SUMMARY OF THE INVENTION

Briefly, the invention comprises a paper gap adjustment mechanism having two coaxially mounted cams and two operating levers for operating the cams to vary the gap between cooperating print elements of a printer. At the heart of the invention is the camming surface profile of the cams which have a camming surface with a linear transition area for forms thickness adjustment and an adjacent ramp area for moving the platen to open position plus a straight radius area at the top of the ramp area. A lever is attached to the cams for both controlling forms thickness and platen gap open but the printer operator actuates this lever itself only when controlling the forms thickness positions. A second lever is rotatable on the cam shaft also. The second lever is provided with detent means engageable by the first lever so that rotation of the second lever rotates the first lever and the cams from the set position of the first lever to the open position. The detent means has multiple set positions at which the first lever is engaged when the first lever is rotated to set thicknesses. Rotation of the second lever from the open position to closed position automatically returns the first lever to the prior set position. The invention also provides means operated by the first lever for indicating the paper thickness setting of the first lever. Means is also provided for detecting when the first lever has rotated to its open position.

It will be seen that the invention is simple in construction and hence economic and simple to operate. Other advantages will become apparent as the description of the invention proceeds.

DETAILED DESCRIPTION OF THE INVENTION

Figure 1:
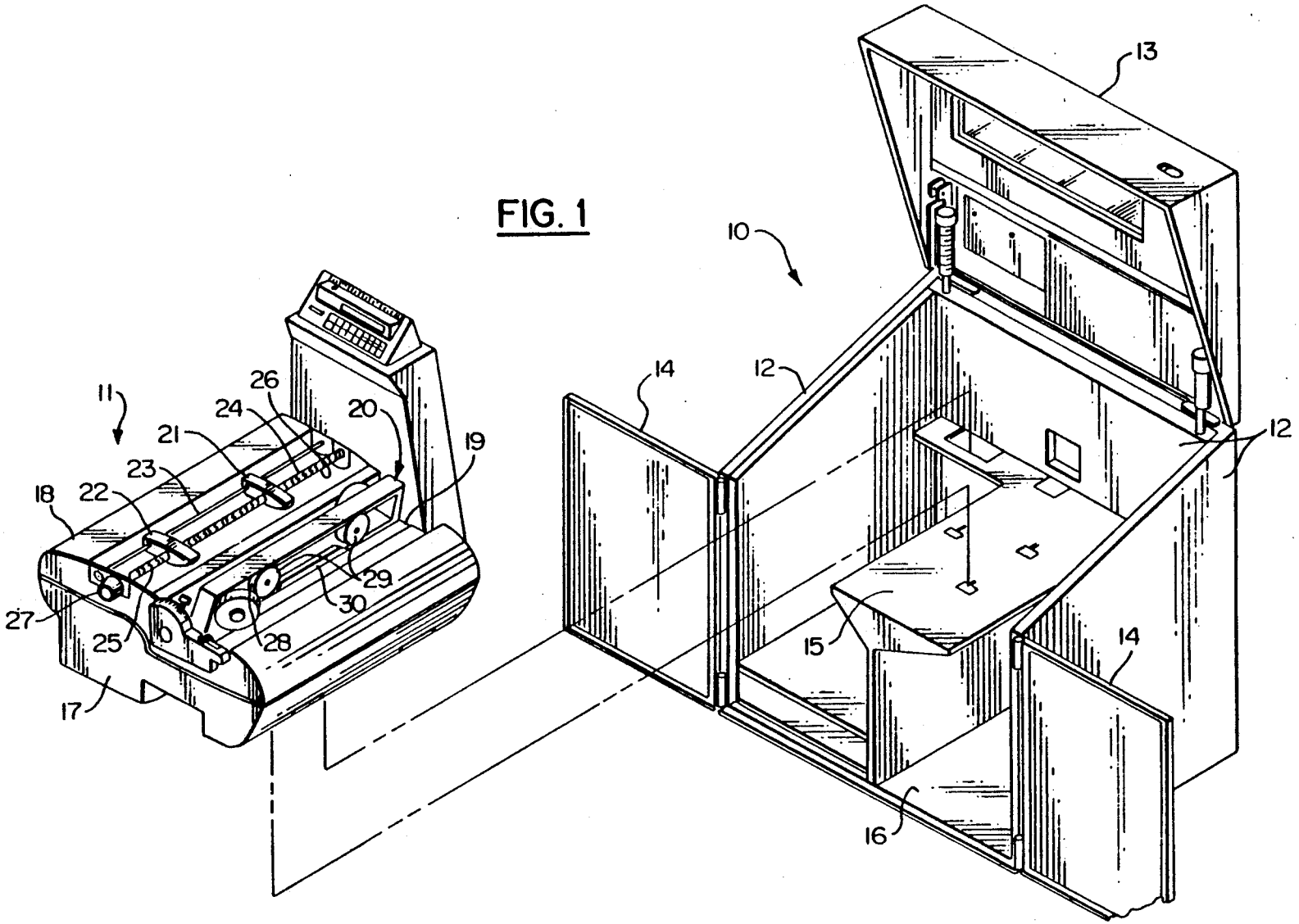
FIG. 1 is an exploded perspective view of a printer apparatus of the type in which the invention may be used.

As seen in FIG. 1, a printer apparatus comprises a cabinet 10 within which is installed a print unit 11. The cabinet 10 has side walls 12 on which top door 13 and a pair of front doors are hingedly attached. A pedestal 15 on bottom wall 16 supports printer unit 11 within the cabinet 10. Stacks of folded paper (not shown) would rest on bottom wall 16 on the right and left sides of pedestal 15.

Printer unit 11 includes a casing having a base 17 and a cover 18 on which is mounted a hammer unit 19. A band and ink ribbon drive assembly 20 is mounted on hammer unit 19 so that a type band and ink ribbon thereof are aligned with and separated from the hammer elements of the hammer unit 19 by a gap which defines a passageway for the ink ribbon and the paper to be printed on. A paper feed system for feeding paper through the gap includes a pair of tractors 21 and 22 on one side of the print mechanism which engage pin feed holes along opposite margins of the paper. Supporting tractors 21 and 22 are parallel drive shaft 23 and guide shaft 24 both rotatably mounted on cover 18. The guide shaft 24 comprises an assembly of coaxial lead screws 25 and 26 which are operated by knob 27 manipulated to adjust the position of tractors 21 and 22.

Figure 2:
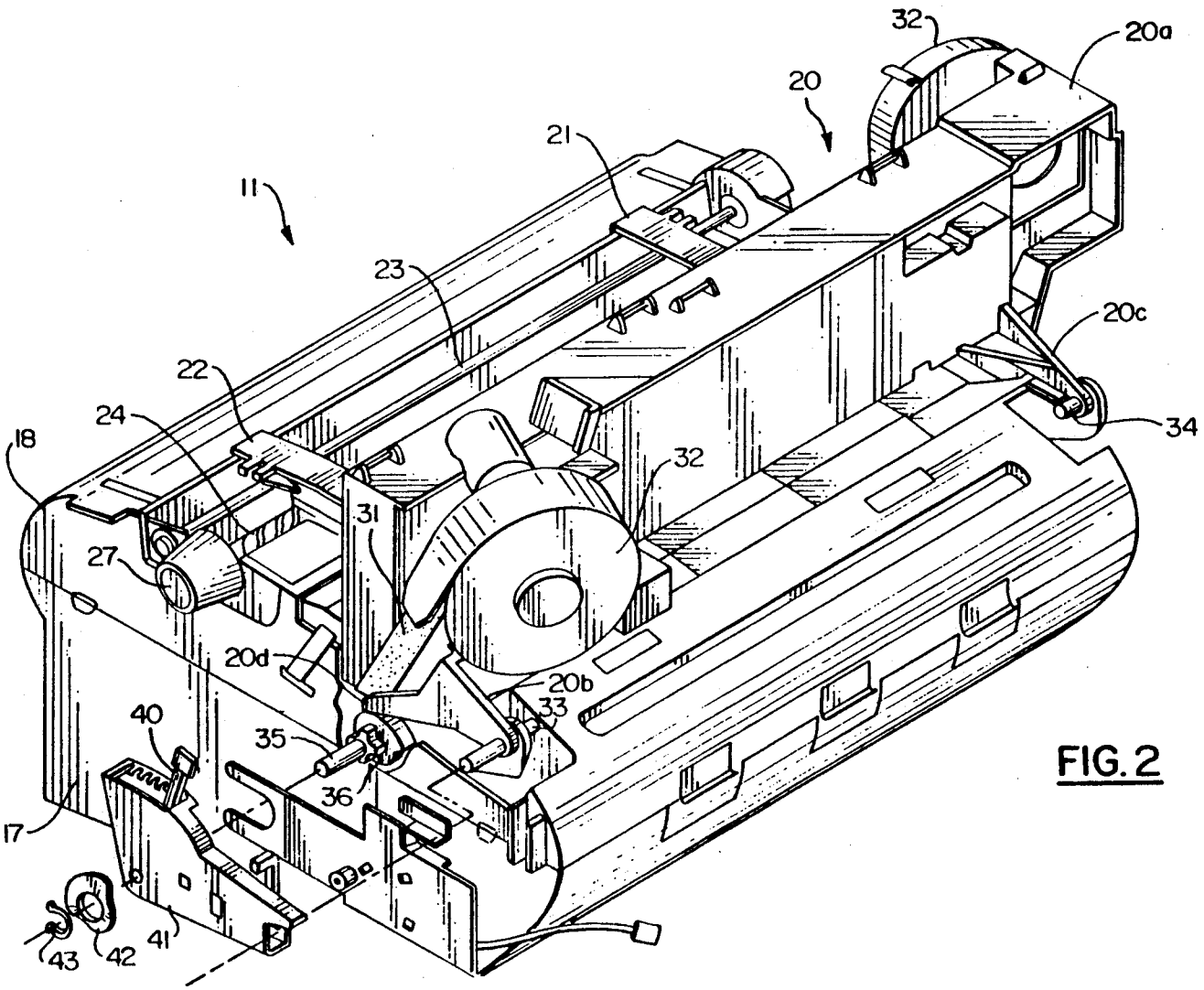
FIG. 2 is a perspective view of the print unit portion of FIG. 1.
Figure 3:
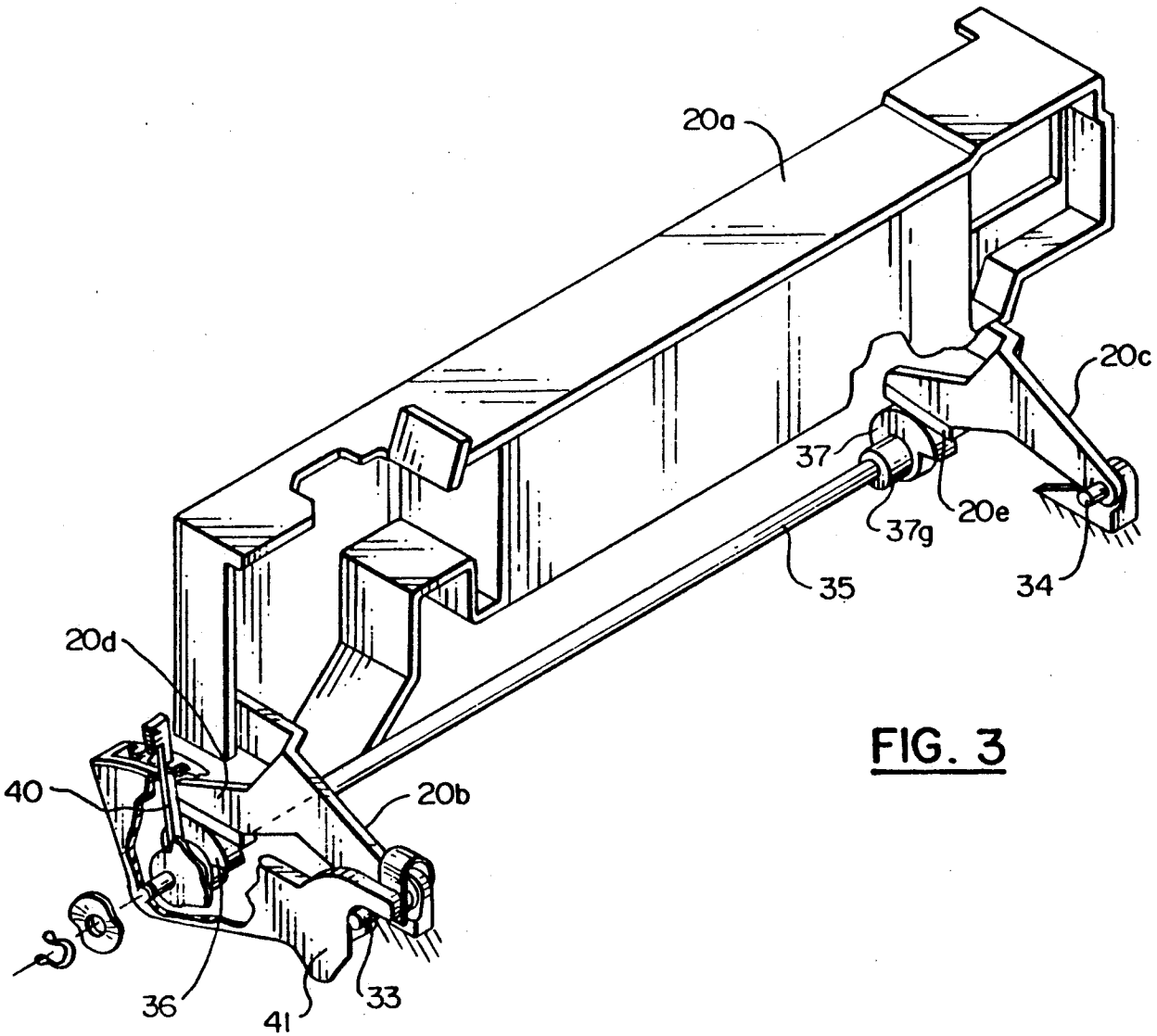
FIG. 3 is a perspective view of a portion of the gap adjusting mechanism which incorporates the invention and which used in the print unit of FIG. 2.

Drive assembly 20 comprises a casting or frame member 20*a*, on which are mounted a type band 28 wrapped around a pair of drive pulleys 29 and a platen 30. As more clearly seen in FIG. 2, an ink ribbon drive is also mounted on casting 20*a* comprising an ink ribbon 31 extending between spool cartridges 32 and along the bottom edge of casting 20*a* and through the gap between type band 28 and hammer unit 19. As best seen in FIGS. 2 and 3, casting 20*a* has separated arms 20*b* 20*c* pivotally attached to in-line pivots 33 and 34 which are attached to cover 18 of the printer unit casing. Also attached to cover 18 is rotatable shaft 35 on which are attached rotary cams 36 and 37. Casting arms 20*b* and 20*c* have extensions 20*d* and 20*e* which ride on the periphery or camming surface of cams 36 and 37 respectively. Rotation of shaft 35 results in cams 36 and 37 raising or lowering extensions 20*d* and 20*e* causing arms 20*b* and 20*c* rotate on pivots 33 and 34 to thereby raise and lower casting 20*a* to thereby change the size of the gap between hammer unit 19 and type band 28.

Figure 12:
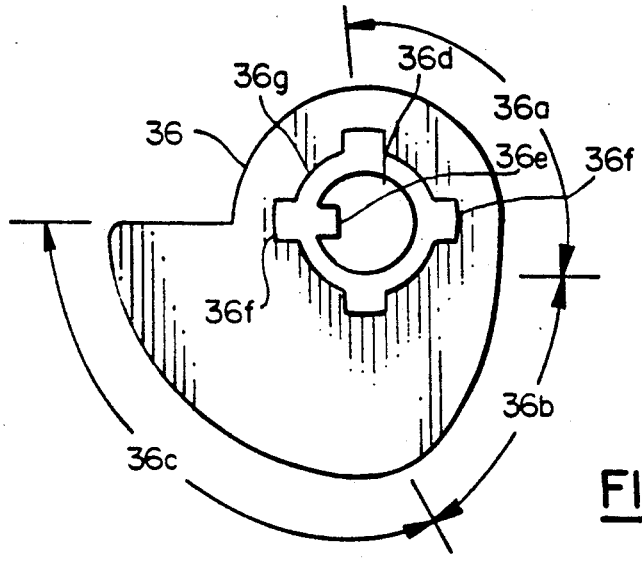
FIG. 12 is a plan view of the cam elements of the mechanism used for adjusting the gap in accordance with the invention.

As seen in FIG. 12, the periphery of cam 36 has a linear transitioning area or sector 36*a*, a ramp area 36*b* and a fixed radius area 36*c*. In the area 36*a*, the radius of curvature of the camming surface increases linearly in the clockwise direction in direct linear proportion to the number of layers, i.e. the thickness of paper to be printed on. When positioned in transitioning area 36*a*, cam 36 sets the paper gap for a particular paper thickness and when moved in the area 36*a*, cam 36 varies the paper gap at a linear rate which matches various paper thicknesses. When traversing ramp area 36*b*, cam 36 produces a rapid enlargement of the paper gap toward the maximum open position. When positioned in area 36*c*, the paper gap has been opened to its maximum or open position by cam 36 in which position paper may be installed into or removed from the paper gap. Cam 36 has a bore 36*d* for receiving shaft 35 which is provided with a longitudinal key slot 35*a* for engagement by cam key 36*e*. Cam 36 has radial keys 36*f* on hub 36*g* for connection to a lever to be described. Cam 37 need not have radial keys on hub 37*a* for reasons which will become apparent but otherwise is identical with cam 36 and will not be described separately. Thus cam 37 is keyed to shaft 35 with the same orientation as cam 36 and operates on extension 20*e* of arm 20*c* in the same manner as described for cam 36.

Figure 7:
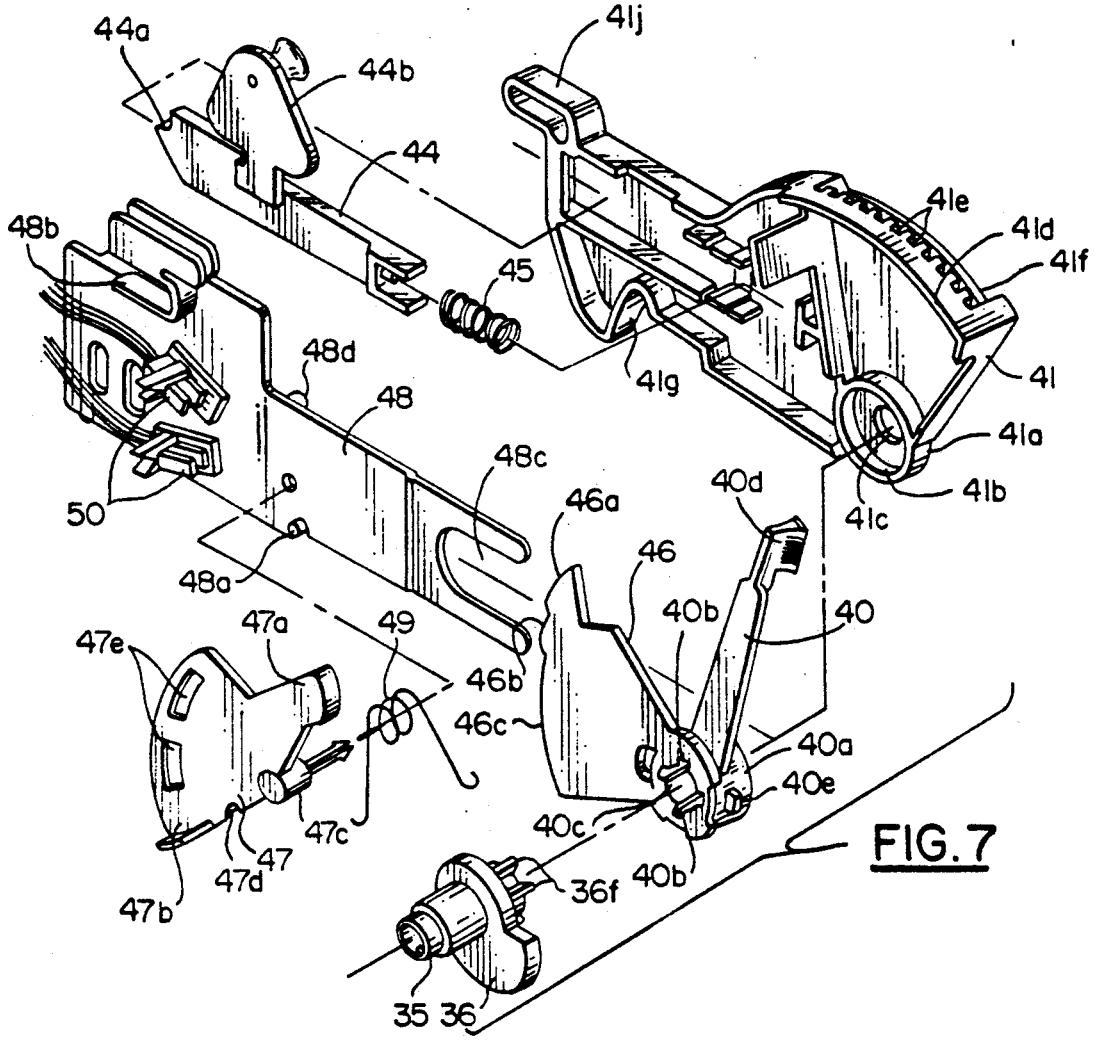
FIG. 7 is an exploded perspective view of the gap adjusting mechanism of FIG. 3.

In accordance with this invention, the gap adjustment mechanism includes two coaxial levers 40 and 41. Lever 40 is rotatable independently of lever 41 for positioning cams 36 and 37 in linear transitioning area 36*a* to adjust the gap for different thicknesses of paper. Lever 40 is rotatable by lever 41 to move cams 36 and 37 from the linear transitioning area 35*a* through the ramp area 35*b* to the open position area 35*c* to open the paper gap and then to return it to the original set position. As best seen in FIG. 7, a hub 40*a* on lever 40 has radial key slots 40*b* around central bore 40*c* which receive keys 36*f* of cam 36. A hub 41*a* on lever 41 has cup like bearing 41*b* and bore 41*c*. Hub 40*a* of lever 40 is journaled in cup bearing 41*b*. Thus lever 40 is rotatable separately and is rotated by lever 41 to perform both thickness adjustment and gap opening operations. In the preferred embodiment of the invention, levers 40 and 41 are both molded polymer parts. Washer 42 and spring clip 43 attached to shaft 35 retain the lever assembly on shaft 35.

Figure 8:
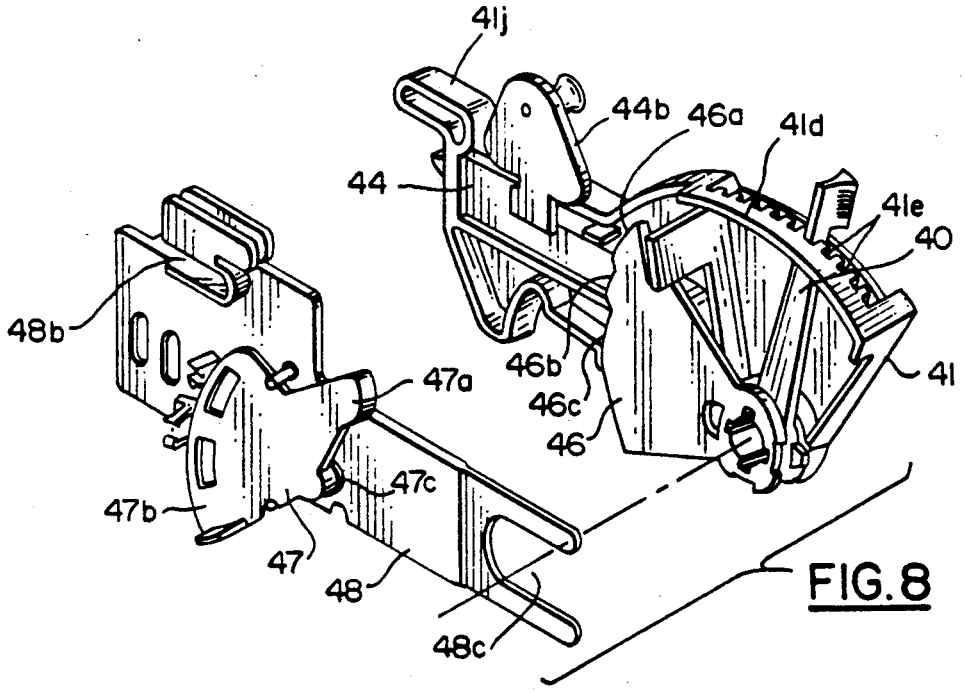
FIG. 8 is an assembled perspective drawing of the mechanism shown in FIG. 7.
Figure 13:
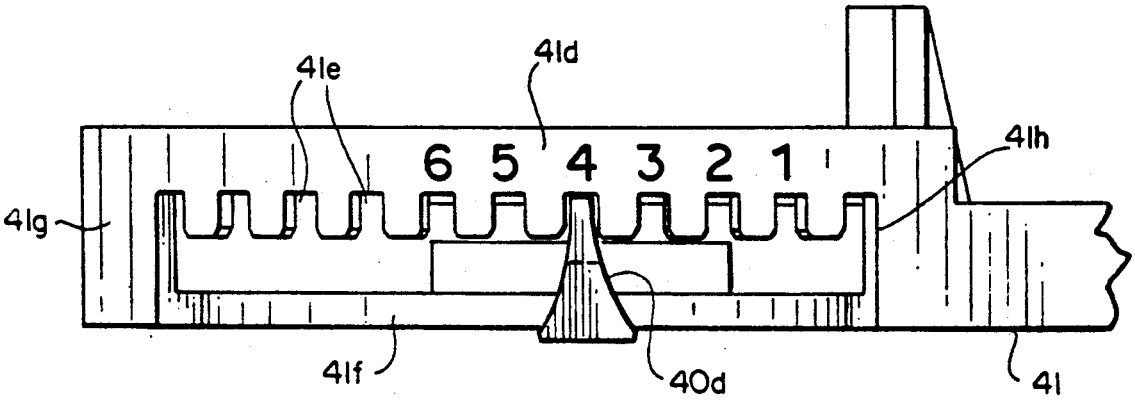
FIG. 13 is a top plan view of a portion of the gap adjustment mechanism showing the paper thickness scale of FIGS. 7 and 8.

As best seen in FIGS. 7, 8 and 13, for setting the gap, lever 40 is operatively connected to lever 41 by detent means. In the preferred embodiment, the detent means comprises a flange 41*d* which projects horizontally from face plate 41*e* of lever 41. Flange 41*d* has an opening for receiving handle 40*d* on on the end of lever 40. Flange 41*d* has notches 41*e* on the edge bordering the opening. Lever 40 has a handle 40*d* which fits into the notches 41*e*. Lever 40 is made somewhat flexible so that handle 40*d* is retained in notches 41*e* by spring loading. To disengage handle 40*d* from notches 41*e*, lever 40 is deflected outwardly until handle 40*d* is clear of the notches 41*e* and lever is free for rotation in either direction to another notch position when a forms thickness adjustment is to be made. A face plate 41*f* limits the outward deflection of lever 40 to prevent overbending. Handle 40*d* springs back into the selected notch 41*e* when released. The number of notches 41*e* and their spacing is dependent on the range of thicknesses of the paper forms. Thus as seen in FIG. 13, scale numerals 41*f* on flange 41*d* are used at the notch positions for indicating the different thicknesses, e.g the number of layers of a multipart form, and hence the different gap settings by cams 36 and 37 within the linear transitioning area 36*a*. As seen in FIG. 13, flange 41*d* has a zero position notch as well as other notches on the other end of the scale. The zero position notch is usable for making an initial setting of cams 36 and 37 to establish an initial setting of the paper gap. The swing arc of lever 40 is designed to correspond to the arc length of linear transition area 36*a* and is limited by the side sections 41*g* and 41*h* which border the sides of the opening in flange 41*d*.

Assembled on lever 41 is bolt 44 and loading spring 45 for locking lever 41 onto the pivot 33 which supports arm 20*b* of casting 20*a*. In this position, lever is in the closed position and the paper gap is set at the position determined by the detented position of lever 40. In the closed position, a handle 41*j* on the end of lever 41 rests on the top of pivot 33. The underside of pivot 33 is engaged by hook 44*a* in the latching end of bolt 44. Handle 44*b* on bolt 44 is operated to release lever 41 from engagement with pivot 33 for manipulation to the open position. As previously described, the swing operation of lever 41 from open to closed position causes lever 40 to rotate cams 36 and 37 from the particular setting in the linear transitioning areas to the open area of the cams at which the paper gap is set open for installation of paper. Upon returning lever 41 to the closed position bolt 44 is cammed by pivot 33 against spring 45 thus allowing arm 41*j* to comes to rest on pivot 33 and then bolt 44 springs back to lock position.

FIGS. 7 and 8 show a mechanism for determining the setting of the paper gap comprises sector cam 46 with an edge having steps 46*a–c* arranged in a pattern. Sector cam 46 extends from hub 40*a* of lever 40 and so is rotatable with lever 40. Each of the steps 46*a–c* correspond to notch settings of lever 40 and hence with gap settings. Cooperating with steps 46*a–c* is mechanical sensor element 47. Sensor element 47 comprises a follower arm 47*a* and flag 47*b* extending radially from a hub 47*c*. Support for sensor element 47 comprises a sensor plate 48 on which is mounted a stub shaft 48*a* for journaling in hub 47*c*. Coil spring 49 is wrapped on hub 47*c* and has one end hooked into slot 47*d* of flag 47 and a second end hooked onto post 48*a* on sensor plate 48. The follower arm 47*a* is biased against the steps 46*a–c* of cam 46 by coil spring 49. Also mounted on sensor plate 48 are a pair of optical sense elements 50. Each optical element 50 comprises a light emitter and a light sensor. Flag 47*b* has windows 47*c* separated by opaque areas which together operate to pass or block the light beams of the optical senses element 50 the combination being operable to produce a binary output signals useful in identifying the position of lever 40. Such signal would be useful by control portion of the printer apparatus of FIG. 1 for various control purposes such as checking whether the lever setting corresponds with the thickness of the paper being used. Sensor plate 48 has slots 48*b* and 48*c* within which are pivot 33 and hub 40*a* respectively to enable sensor plate to be moved longitudinally. Follower arm 47*a* being spring loaded against camming are 46*a* of sector cam 46 biases plate 48 away from hub 40*a*. Sensor plate 48 is moved longitudinally when post 48*d* is released from slot 41*g* when lever 41 is unlatched and rotated to open position. This causes follower arm 47*a* to move out of engagement with cam 46. As a consequence, coil spring 49 rotates sensor element 47 to the position where stop flange 47*f* of flag 47*b* rests against a sense element 50 on sensor plate 48. In this position, flag 47*b* is positioned to interrupt both light beams of optical sense elements to produce a control signal indicating that lever 41 is in open position and that the gap is open for loading of paper.

Figure 4:
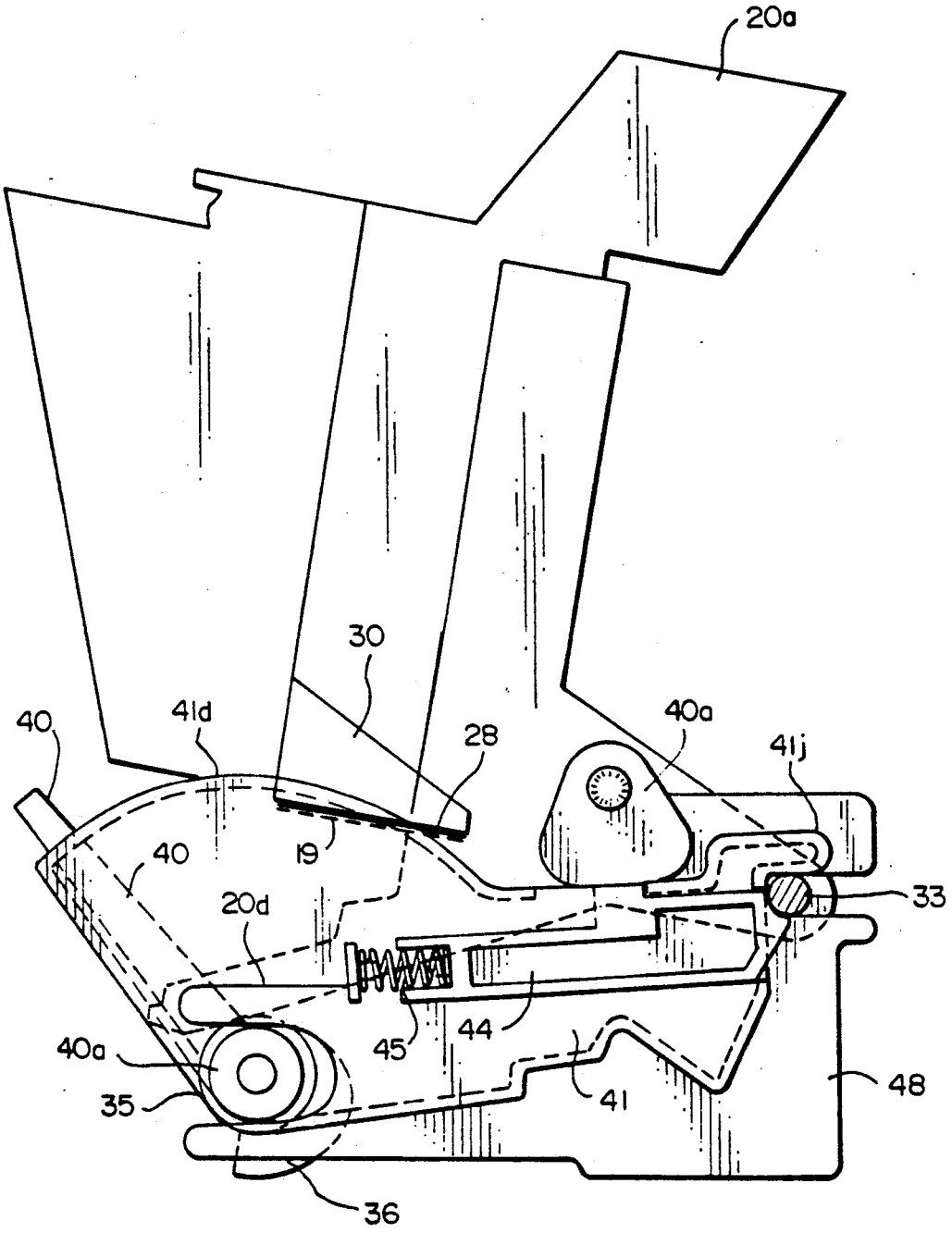
FIGS. 4–6 are elevation views of the gap adjusting mechanism of FIG. 3 showing three operating positions.

FIG. 4 shows lever 41 is latched by bolt 44 in its closed position and lever 40 is set at an initial setting. In this position, cams 36 and 37 have set casting 20*a* to the highest position at which the gap between type band 18 over platen 30 relative to hammer unit 19 (as shown by the dotted line is at its largest print setting. From this position, lever 40 can be rotated as previously described to various detent notch positions on lever 41 and thereby causing linear transitioning areas of cams 36 and 37 to move casting 20*a* on pivots 33 and 34 and thus increase the gap setting.

Figure 5:
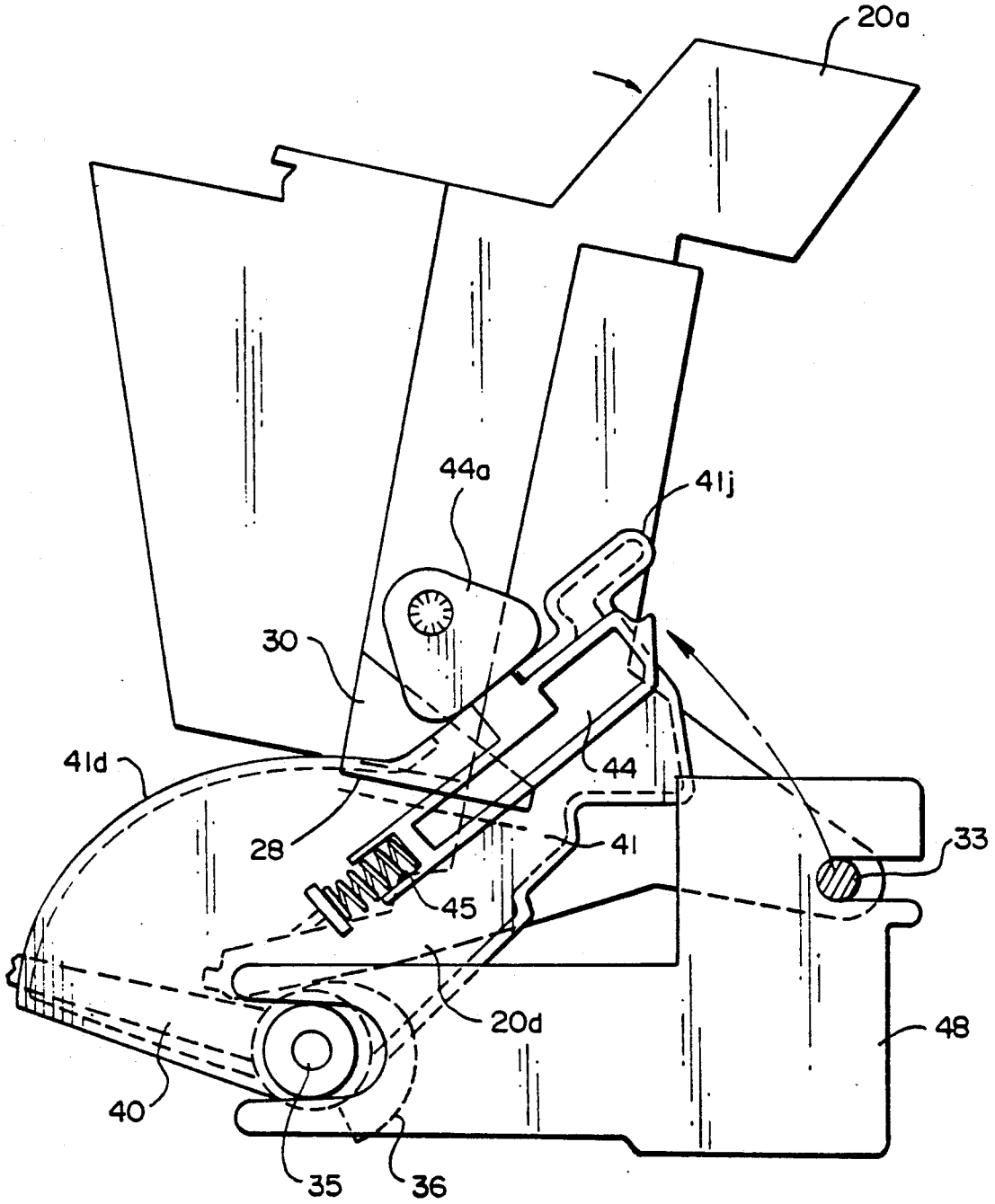

FIG. 5 shows the lever 41 in unlocked position in the course of being rotated to open position. Lever 40 is in the initial position in FIG. 4. In this state, lever 40 by virtue of being detented to lever 41 causes cams 36 and 37 to rotate into the ramp areas to lift casting 20*a* about pivots 33 and 34 with the gap being enlarged toward open position.

Figure 6:
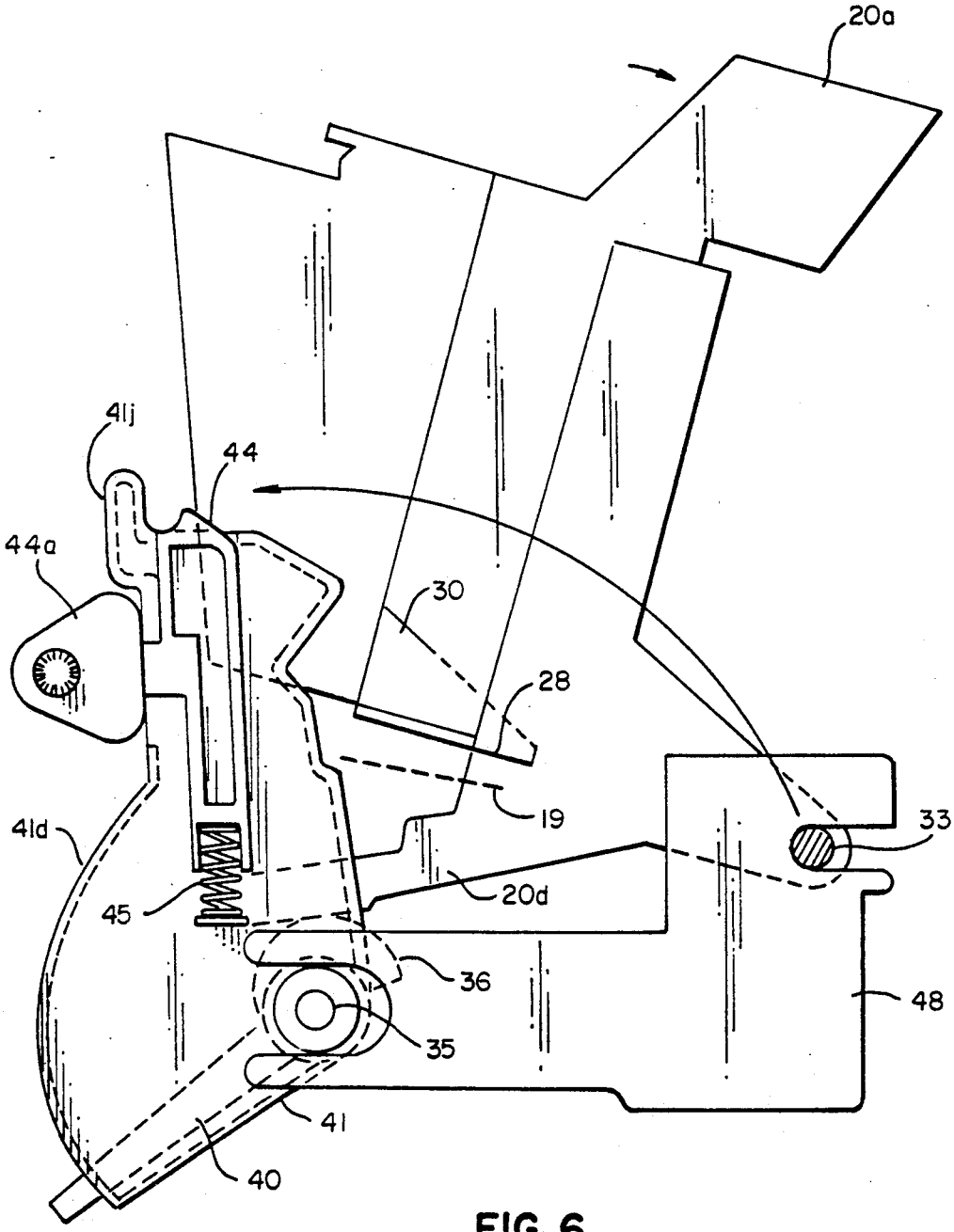

In FIG. 6, lever 41 is in full open position, lever 40 is in the original detent position and cams 36 and 37 have been rotated to the degree where the arms 20*d* and 20*e* ride on the maximum radius are of the cams. In this position, the gap between type band 28 and hammer unit 19 is at maximum open position. From this position, lever 41 can be rotated in the reverse direction to the closed position shown in FIG. 4. It is significant to note, that due to the detenting of lever 40 to 41, the casting is lowered to the same gap setting previously set by lever 40.

Figure 9:
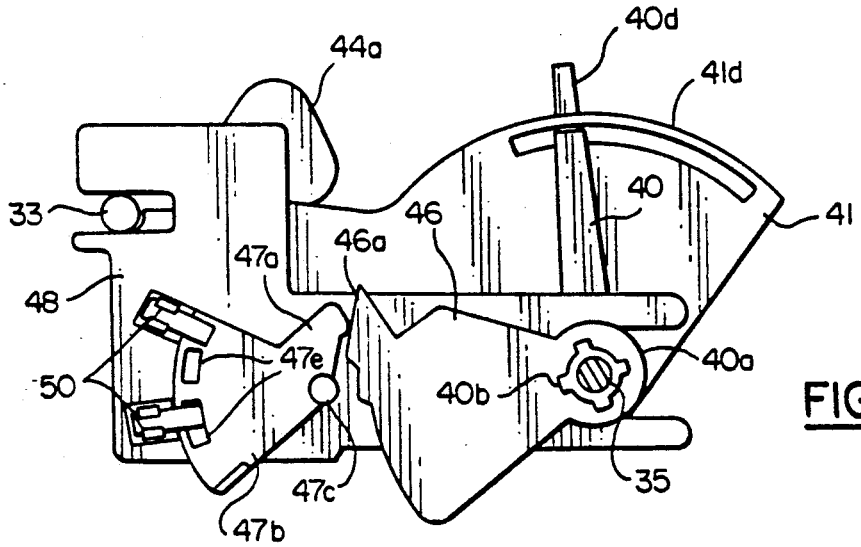
FIGS. 9–11 are elevation views of the gap adjusting mechanism from another direction showing details of the gap identification elements of the invention.

FIG. 9 shows lever 41 in closed position and lever 40 in a low order position of detent notches 40*e* corresponding to a gap setting for a single thickness of paper. In this position, follower arm 47*a* of mechanical sensor 47 is held in engagement against step 46*a* on cam 46 by spring 49 and by sensor plate 48 being in the rightmost position. In this position of cam 46, flag 47 is set to block on light beam and to pass one light beam of sensor elements 50 which sends a binary signal useful by the electronic control for changing as well as for setting the energy level of the hammers of unit 19 to the proper level.

Figure 10:
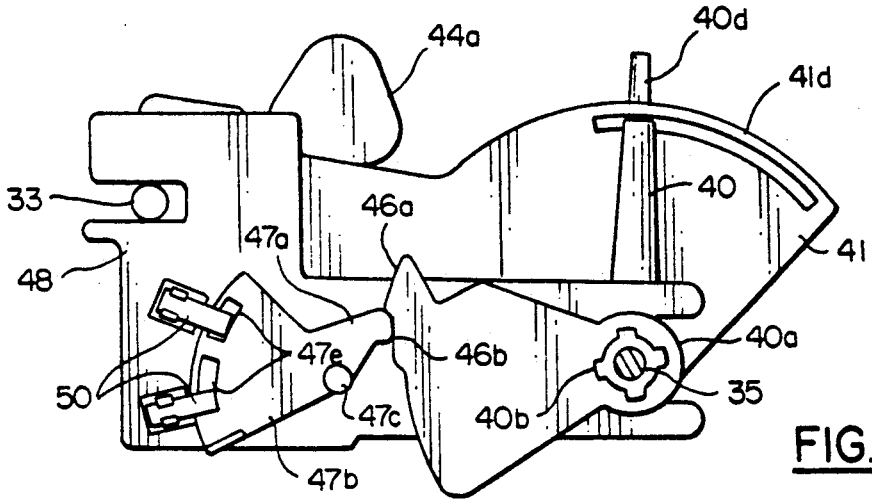

In FIG. 10, lever 40 is set at a different detent position in notches 41*e* of lever 41 and cam 46 has been rotated to the position at which follower arm 46*a* engages step 46*b* of cam 46. In this position, flag 47*d* has both windows 47*e* positioned for passing both light beams. Consequently a new signal is generated to the printer controls indicating a new gap setting for thicker paper which in turn might direct a new energy level setting for the hammers of unit 19.

Figure 11:
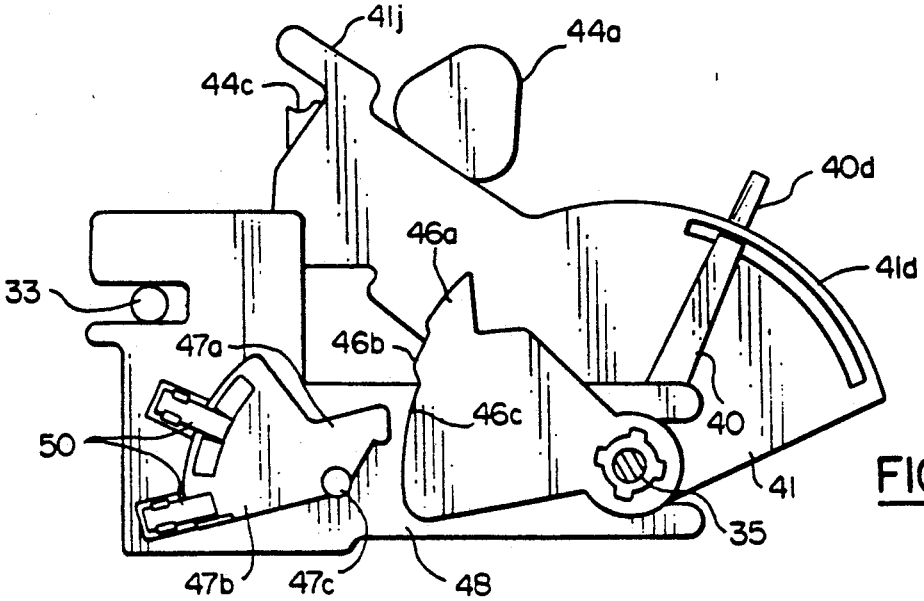

FIG. 11 shows lever 41 unlatched and on the move to the open position. In this position, spring 49 has moved sensor plate 48 longitudinally to disengage follower arm 47*a* from cam 46. Under influence of spring 49, sensor element 47 has been rotated so that neither window 47*e* is aligned with the light beams of the sensor elements and the beams are both blocked thereby producing a control signal indicating that the gap is open.

Thus it can be seen that the invention provides a mechanism for gap setting which in effect adjusts the paper gap for paper having different thickness and is convenient to operate. While the invention is described in particular with reference to a single embodiment, it will readily occur to a person skilled in the art that various changes can be made without departing from the scope of the invention.

What is claimed is:

1. A printer apparatus comprising in combination first and second cooperating print elements, said print elements being arranged to form a gap for the passage of print media therebetween, and gap changing means including cam means operable to effect relative movement of said first and second print elements to vary the magnitude of said gap, said cam means having a camming surface profile with a linear transitioning area for media thickness setting and a ramping area for opening said gap, a first lever for rotating said cam means in said transition area and said ramping area to open said gap, and a second lever having detent means for holding said first lever at a particular setting in said transition area, said second lever being operable for rotating said first lever from said particular setting to open said gap.

2. A printer apparatus comprising in combination first and second cooperating print elements, said print elements being arranged to form a gap for the passage of print media therebetween, and gap changing means including cam means operable to effect relative movement of said first and second print elements to vary the magnitude of said gap, said cam means having a camming surface profile with a linear transitioning area for media thickness setting and a ramping area for opening said gap, a rotatable shaft means supporting said cam means, a first lever operatively connected to said shaft for rotating said cam means to positions in said transitioning area and through said ramping area to an open gap position, and a second lever rotatable on said shaft means, detent means connecting said first lever to said second lever.

3. A printer apparatus comprising in combination first and second cooperating print elements, said print elements being arranged to form a gap for the passage of print media therebetween, and gap changing means including a rotatable shaft, cam means rotatable by said shaft, said cam means having a camming surface profile including a first area useful for setting the thickness and a second adjacent area for opening said gap, a first lever for rotating said shaft to position said cam means in said first or second area, a second lever rotatable on said shaft, and detent means connecting said first and second levers and allowing the rotation of said first lever for positioning said cam means in said first area and for holding said first lever for rotation by said second lever for positioning said cam means from said first area to said second area to open said gap.

4. A printer apparatus comprising in combination first and second cooperating print elements, said print elements being arranged to form a gap for the passage of print media therebetween, and gap changing means including cam means operable to effect relative movement of said first and second print elements to vary the magnitude of said gap, said cam means having a first operative area for vary said gap to accommodate media of various thickness and a second operative area for further enlarging said gap to an open condition;

a first lever for operating said cam means, and a second lever for controlling the operation of said first lever to vary said gap and for operating said first lever to enlarge said gap to said open condition.

5. A printer apparatus in accordance with claim 4 which further comprises detent means on said second lever for controlling the operation of said first lever to vary said gap and for holding said first lever during operation thereof by said second lever.

6. A printer apparatus in accordance with claim 5 wherein said detent means comprises plural detent settings for controlling the operation of said first lever to vary said gap, and said first lever is maintained in a particular detent setting of said detent means during the operation of said first lever by said second lever to said open condition of said gap.

7. A printer apparatus in accordance with claim 6 which further comprises indicator means operable by said first lever for indicating the particular detent setting of said first lever, and control means responsive to said indicator means for producing a control signal useful for identifying said detent setting.

8. A printer apparatus in accordance with claim 7 wherein said indicator means is operable for indicating when said first lever has been operated to said open position by said second lever, and said control means is operable to said indicator means for producing a control signal useful for identifying said lever being moved to said open position by said second lever.

9. A printer apparatus in accordance with claim 7 wherein said indicator means comprises a position indicator operable by said first lever for indicating the detent position of said first lever in said detent means, said control means includes position sensor means for producing a control signal which identifies the position of said position indicator.

10. A printer apparatus in accordance with claim 9 wherein said position indicator is a sector plate rotatable by operation of said first lever, said sector plate having step like means for indicating the detent position of said first lever, and said control means includes mechanical sensor means operable by said step like means for producing said control signal.

11. A printer apparatus in accordance with claim 10 wherein said control means further includes optical sensor means for producing said control signal in response to operation of said mechanical sensor means.

12. A printer apparatus in accordance with claim 11 wherein said mechanical sensor means includes flag means movable in response to said step like means of said sector plate, and said optical sensor means is operable in response to movement of said flag means for producing said control signal.

* * * * *